US005095709A

United States Patent [19]

Billiot

[11] Patent Number: 5,095,709

[45] Date of Patent: Mar. 17, 1992

[54] LIQUID NITROGEN TO GAS SYSTEM

[76] Inventor: Henry M. Billiot, Rt. 4,Box 81 J, Dayton, Tex. 77535

[21] Appl. No.: 545,428

[22] Filed: Jun. 27, 1990

Related U.S. Application Data

[63] Continuation-in-part of Ser. No. 421,911, Oct. 16, 1989, abandoned.

[51] Int. Cl.[5] ..... F17C 9/04

[52] U.S. Cl. ..... 62/50.3; 60/618; 60/648

[58] Field of Search ..... 62/50.3; 60/618, 648

[56] References Cited

U.S. PATENT DOCUMENTS 3,229,472 1/1966 Beers ..... 62/53
4,197,712 4/1980 Zwick et al. ..... 60/648
4,290,271 9/1981 Granger ..... 62/53
4,409,927 10/1983 Loesch et al. ..... 122/26
4,420,942 12/1983 Davis et al. ..... 62/50.3
4,438,729 3/1984 Loesch et al. ..... 62/50.3
4,458,633 7/1984 Loesch ..... 122/26
4,519,213 5/1985 Brigham et al. ..... 62/50.3
4,819,454 4/1989 Brigham et al. ..... 62/50.3

*Primary Examiner*—Ronald C. Capossela
*Attorney, Agent, or Firm*—Fulbright & Jaworski

[57] ABSTRACT

A nitrogen liquid to gas system in which an internal combustion engine drives hydraulic pumps and motors in a closed ethylene gylcol fluid circuit. A heat exchanger is provided between the liquid nitrogen and the ethylene glycol fluid for converting the liquid nitrogen to gaseous nitrogen. Heat is recovered from the ambient air in a heat exchange with the ethylene glycol fluid for maintaining the fluid between approximately 0° F. and 20° F. by means of a temperature regulating valve.

4 Claims, 2 Drawing Sheets

LIQUID NITROGEN TO GAS SYSTEM

CROSS REFERENCE TO RELATED APPLICATIONS

The present application is a continuation-in-part of application Ser. No. 07/421,911, filed Oct. 16, 1989, entitled Liquid Nitrogen to Gas System, now abandoned.

BACKGROUND OF THE INVENTION

The present invention is directed to a system for converting liquid nitrogen to gaseous nitrogen. It is well known to convert liquid nitrogen to gaseous nitrogen which can be used in industrial, petrochemical and oil field industries. For example, it is known, as disclosed in U.S. Pat. No. 4,920,271, to provide a self-contained, flameless nitrogen liquid to gas converter. However, such systems require high horsepower engines, or additional heat engines as in U.S. Pat. No. 4,458,633. These systems operate at a greater level of power than necessary, driving multiple pumps and motors. The prior art systems use loading devices such as hydraulic variable back pressure valves to create a load on the engines. These high horsepower engines consume large amounts of fuel, for converting the fuel consumed to waste heat which is transferred to a number of different heat exchangers which increase the complexity of the system and leads to reduced reliability.

SUMMARY

The present invention is directed to a nitrogen liquid to gas vaporizing and pumping system which includes an internal combustion engine sufficient to power only the nitrogen pump, an ethylene glycol fluid (EGF) pumping system connected to and driven by the engine and a EGF motor actuated by the EGF pump. The EGF pumping system is in a closed circuit and includes EGF which drives the motors and is circulated through a nitrogen-EGF heat exchanger in which the liquid nitrogen is vaporized to gaseous nitrogen. The EGF fluid has a dual function as a power fluid and as a heat transfer fluid. A nitrogen pump is connected to and driven by the EGF motor for pumping liquid nitrogen through a line. An air-EGF heat exchanger is in the closed EGF circuit downstream of the nitrogen-EGF heat exchanger for heating the cooled EGF, to provide most of the required heat.

The engine exhaust could also be utilized as an auxiliary heat source as in the prior art.

A still further object of the present invention is the EGF which is a mixture of ethylene glycol (60%) and water (40%) which has the capability of providing lubrication and viscosity, as that of oil, when the temperature is maintained between approximately 0° F. and +20° F. Therefore, it can be used as a combined fluid to transfer power from the engine to the nitrogen pump first, then the same EGF will carry the heat from the air-EGF heat exchanger to the EGF-liquid nitrogen heat exchanger. Additional advantages of using a non-oil based fluid are evident, such as being low polluting effect and non-flammable. The use of EGF eliminates the oil used as the intermediate fluid as well as multiple hydraulic pumps, motors, loading valves, controls and associated heat exchangers as utilized in prior art systems.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
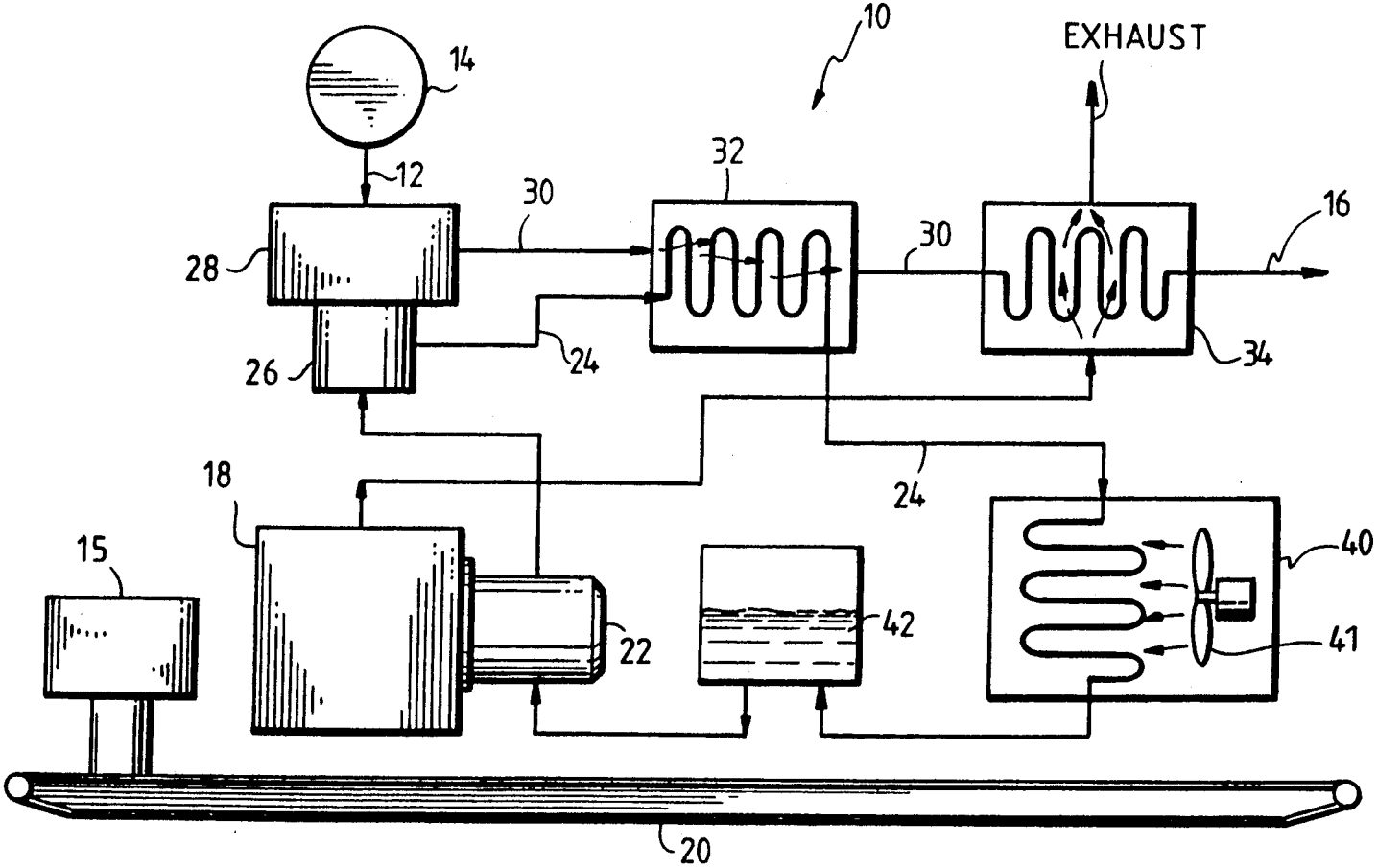

Referring now to the drawings, the reference numeral 10 generally indicates the nitrogen liquid to gas system of the present invention and generally includes an inlet liquid nitrogen line 12 receiving liquid nitrogen from a suitable supply tank 14, a nitrogen line 30, and a gaseous nitrogen outlet line 16 for conducting the now vaporized high pressure, such as 10,000 psi, nitrogen from the system 10.

A suitable internal combustion engine 18 is mounted on a self-contained support 20 with other components whereby the system 10 may be suitably transported to remote areas where nitrogen gas is required. The engine 18 provides all of the power necessary for the system 10 and is connected to and drives an EGF pump 22 which pressurizes ethylene glycol fluid in a closed ethylene glycol fluid circuit 24. The EGF pump 22, a fixed displacement pump, is mechanically connected to and actuated by the engine 18. The ethylene glycol fluid in the closed circuit 24 actuates an EGF motor 26 which is connected to and drives a nitrogen pump 28. The speed of operation of the liquid nitrogen pump 28 is controlled by the speed of hydraulic motor 26 which in turn is operated by control valve 29 and actuated by sequence valve 31.

Figure 2:
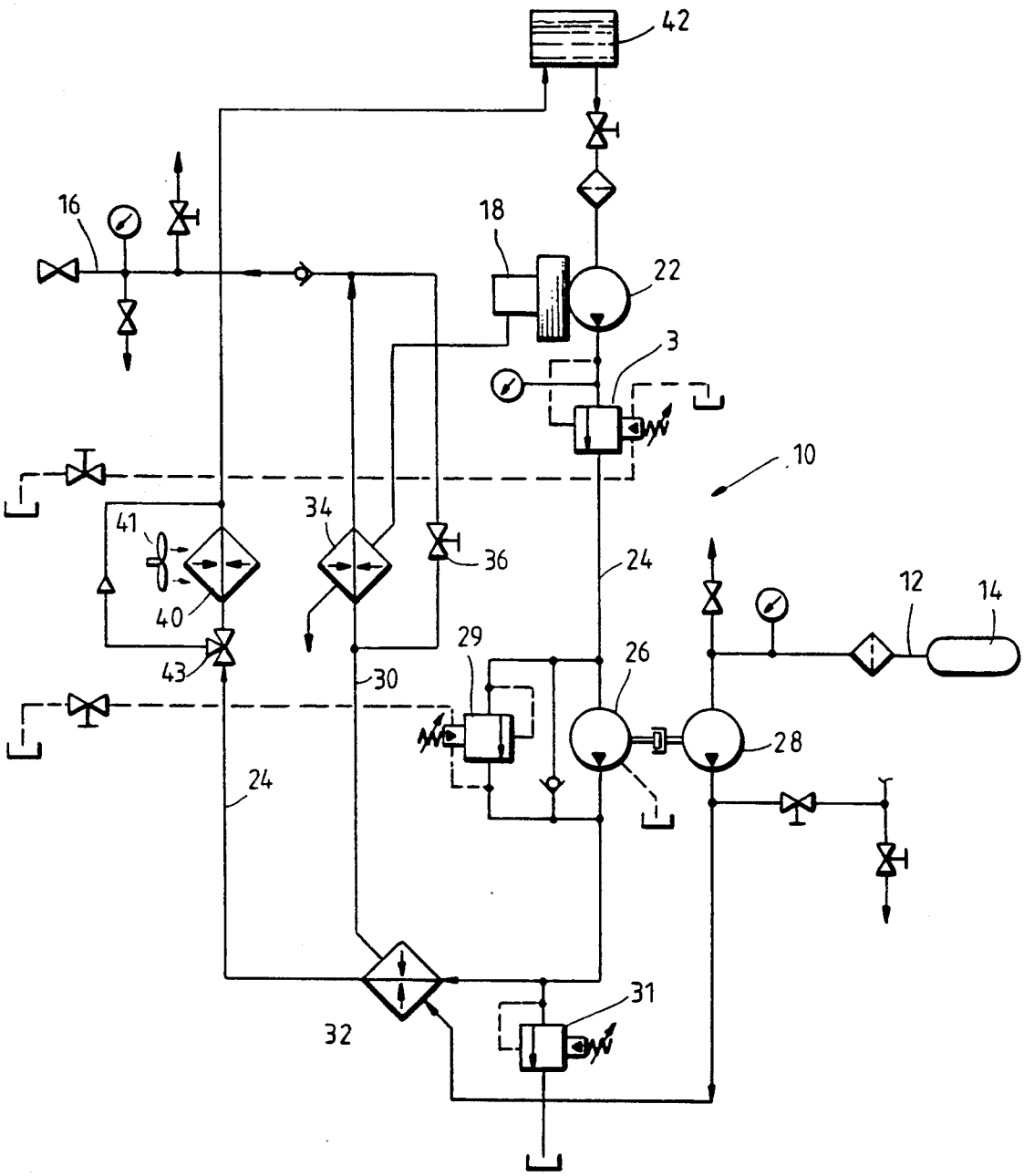

The liquid nitrogen from line 12, which is connected to the pump 28, is pressurized, such as up to 10,000 psi, and flows through the nitrogen line 30, as indicated in the heavy lines (FIG. 2) as compared to the closed ethylene glycol fluid circuit 24 which is indicated in the lighter lines 24. A nitrogen-ethylene glycol fluid heat exchanger 32 is provided between the nitrogen line 30 and the closed ethylene glycol fluid circuit 24 for converting the liquid nitrogen into gaseous nitrogen.

The internal combustion engine 18 can be utilized as an auxiliary heat source to increase the nitrogen gas discharge temperature above the ambient temperature as utilized in prior art systems. The now vaporized nitrogen continues its flow through the nitrogen line 30 to an engine exhaust-nitrogen gas heat exchanger 34 connected to the nitrogen line 30 downstream of the nitrogen-EGF heat exchanger 32 for receiving exhaust heat from the internal combustion engine 18. From the heat exchanger 34, the now warm gaseous nitrogen flows to the outlet line 16 for suitable utilization. If desired, a manual valve 36 is provided in parallel with the heat exchanger 34 to allow a small flow of nitrogen to bypass around the heat exchanger 34 to control the discharge temperature of the gaseous nitrogen if desired.

The EGF in the closed circuit 24, directly receives frictional heat generated by mechanical loss from the EGF pump 22 and motor 26, a large amount of heat was extracted from the EGF in heat exchange with the liquid nitrogen in the heat exchanger 32 for converting the liquid nitrogen to gaseous nitrogen. The now cooled EGF is circulated through an air-EGF heat exchanger 40 with a fan 41 where a large amount of heat from the atmosphere or ambient air is in exchange with the EGF to increase the temperature of the EGF to the working temperature of between 0° F. and 20° F. The temperature regulator 43 is used in the EGF circuit 24 to assure the working temperature of the EGF is maintained between 0° F. and 20° F. at which temperature EGF exhibits some of the similar characteristics of hydraulic oil, viscosity and lubricity. The EGF uses the available heat in the atmosphere for increasing the temperature of the EGF, for converting or changing the nitrogen state from liquid to gas. The heated EGF is then returned to the reservoir 42 and is recycled.

The present invention provides a liquid to gaseous nitrogen vaporizing and pumping system which is self-contained, has one single internal combustion engine 18 which provides the required horsepower to power the liquid nitrogen pump 28 only and a large air-to-EGF heat exchanger 40 which provides most of the heat required to vaporize the liquid nitrogen to gaseous nitrogen. Unlike prior art systems the present invention uses the EGF circuit 24 to power the liquid nitrogen pump 28, absorb heat from the ambient air and release the heat at the liquid nitrogen to EGF heat exchanger 32 to vaporize the liquid nitrogen to gaseous nitrogen all in one circuit 24. Thus the present invention is simpler and has fewer and less complex components than the prior art systems. Systems of the prior art use an oversized engine resulting in increased costs to manufacture and operate. The oversized engine needs to be loaded to the maximum output power to generate heat in either a hydraulic oil circuit or an automatic transmission fluid circuit, and then the heat is recovered by the engine coolant before it is transferred to the liquid nitrogen vaporized as in U.S. Pat. 4,290,271 or the oversized engine is loaded by a mechanical frictional brake as in U.S. Pat. 3,229,472 or loaded by a water brake device as in U.S. Pat. 4,409,927 or by a transmission retarder in U.S. Pat. 4,409,927. The present invention utilizes the closed EGF circuit 24 to power the liquid nitrogen pump 28 and vaporize the liquid nitrogen to gaseous nitrogen, recovering the heat necessary to perform this operation from the ambient air in one circuit.

A feature of the present invention is the use of the EGF as the main power fluid when the temperature is maintained between approximately 0° F. and 20° F. and also as a heat transfer fluid. The EGF, between these temperatures, has the same characteristics of viscosity and lubricity as oil. Therefore, the use of EGF at temperatures of substantial between 0° F. and 20° F. provide longer life for the hydraulic pumps and motors. The temperature of the EGF is properly maintained by the temperature regulating valve 43. The EGF is simultaneously providing power to the motor 26 and transferring heat to the nitrogen heat exchanger 32. Prior art systems have to use engine coolant to carry the heat generated by the internal combustion engine and the heat generated by the hydraulic circuit to the nitrogen heat exchanger.

While the EGF circuit 24 may pick up frictional heat at pump 22 and motor 26, the amount of heat gained will not adversely affect the viscosity of the EGF and similarly the temperature in the EGF circuit 24 may fall below 0° F. at the output of heat exchanger 32 and the temperature will be controlled at heat exchanger 40 by the temperature regulating valve 43 to again bring the temperature between 0° F. and 20° F. prior to its return to the reservoir 42.

As indicated in FIG. 1, all of the components may be carried on the support 20 including a control panel 15 which incorporates the various pressure, temperature gauges, valves and engine monitoring equipment. It is understood that in the actual embodiment additional conventional valves, accumulators and gauges, as well as surge tanks, are provided in a suitable control circuit.

In the design of one system 10, the temperature pressure of the incoming liquid nitrogen in inlet line 12 was −320° F. and 30 psi, and an output of gaseous nitrogen at a temperature and pressure of 70° F. (+ or −20°) and 10,000 psi for a flow rate of 90,000 SCFH should be obtained. In such a system the internal combustion engine 18 may be a Deutz diesel, the pump 22 a model P 125 Commercial Shearing, the motor 26 may be a Model M 125 Commercial Shearing, the pump 28 may be an Airco 3 GMPD, and the heat exchangers 32 may be a Cryogenic Technology heat exchanger, 34 may be a Cryogenic Technology heat exchanger and 40 may be a Young Mfg. heat exchanger.

The present invention, therefore, is well adapted to carry out the objects and attain the ends and advantages mentioned as well as others inherent therein. While presently preferred embodiment of the invention is given for the purpose of disclosure, numerous changes in the details of construction, arrangement of parts, and steps of the process may be made which will readily suggest themselves to those skilled in the art and which are encompassed within the spirit of the invention and the scope of the appended claims.

What is claimed is:

1. A liquid nitrogen to gaseous nitrogen vaporizing and pumping system comprising, an internal combustion engine with sufficient horsepower to power a cryogenic pump to maximum flow and pressure, an ethylene glycol fluid pump connected to and driven by the engine, an ethylene glycol fluid motor driven by the ethylene glycol fluid pump, a nitrogen pump connected to and driven by the ethylene glycol fluid motor for pumping liquid nitrogen through a line, said ethylene glycol fluid pump and ethylene glycol motor being in a closed ethylene glycol circuit through which the ethylene glycol fluid flows, a liquid nitrogen-ethylene glycol fluid heat exchanger between the liquid nitrogen line and the closed ethylene glycol fluid circuit for converting the liquid nitrogen to gaseous nitrogen, an air-ethylene glycol fluid heat exchanger connected to the closed ethylene glycol fluid circuit downstream of the nitrogen-ethylene glycol fluid heat exchanger for heating the cooled ethylene glycol fluid, and an engine exhaust-nitrogen gas heat exchanger connected to the nitrogen line downstream of the nitrogen-ethylene glycol fluid heat exchanger to increase the temperature of the gaseous nitrogen as desired.

2. The apparatus of claim 1 wherein the ethylene glycol fluid comprises, a mixture of approximately sixty percent ethylene glycol and forty percent water.

3. The apparatus of claim 1 including a temperature regulator to maintain the temperature of the ethylene glycol mixture between substantially 0° F. to 20° F. throughout the ethylene glycol fluid system.

4. The apparatus of claim 1 wherein the temperature regulator controls the amount of EGF through the air-EGF heat exchanger.

* * * * *